US005850634A

United States Patent [19]

Toombs

[11] Patent Number: 5,850,634

[45] Date of Patent: Dec. 22, 1998

[54] UPPER BODY CLOTHING ARTICLE CONVERTIBLE INTO A CARRYING ARTICLE

[76] Inventor: Timothy B. Toombs, 6790 Browns Mill Lake Rd., Lithonia, Ga. 30038

[21] Appl. No.: 990,621

[22] Filed: Dec. 15, 1997

[51] Int. Cl.[6] ..... A45F 4/00; A41D 1/02

[52] U.S. Cl. ..... 2/93; 2/97; 224/576

[58] Field of Search ..... 2/69, 69.5, 70, 2/85, 93, 95, 96, 97, 100, 108, 94, 86, 89, 115, 247; 224/576, 577

[56] References Cited

U.S. PATENT DOCUMENTS

| | | | |
|---|---|---|---|
| Re. 35,814 | 6/1998 | Olson | 2/159 |
| 1,959,331 | 5/1934 | Bour . | |
| 2,058,474 | 10/1936 | Long . | |
| 2,146,243 | 2/1939 | Aug . | |
| 2,248,455 | 7/1941 | Freund . | |
| 2,493,977 | 5/1950 | Kochman | 2/18 |
| 4,057,854 | 11/1977 | Phelps, Sr. . | |
| 4,078,264 | 3/1978 | DeGennaro et al. | 2/88 |
| 4,307,470 | 12/1981 | Ezell . | |
| 4,389,735 | 6/1983 | McLaughlin . | |
| 4,404,687 | 9/1983 | Hager . | |
| 4,476,587 | 10/1984 | Itoi . | |
| 4,502,154 | 3/1985 | Itoi | 2/108 |
| 4,502,155 | 3/1985 | Itoi . | |
| 4,563,777 | 1/1986 | Park . | |
| 5,115,519 | 5/1992 | Dalrymple | 2/311 |
| 5,123,117 | 6/1992 | Prendergast . | |
| 5,490,619 | 2/1996 | Boyar | 224/153 |
| 5,743,448 | 4/1998 | Tsai | 224/153 |

*Primary Examiner*—Michael A. Neas
*Assistant Examiner*—Tejash D. Patel
*Attorney, Agent, or Firm*—Jones & Askew, LLP

[57] ABSTRACT

A lined upper body clothing article, such as a jacket, that includes a carrying article, such as a tote bag, concealed between the rear panel of the jacket shell and the rear panel of the jacket lining. One wall of the carrying article is sewn or zippered to the lining, but the shell of the jacket is not attached to the carrying article. The mouth of the carrying article is located at a zippered seam between the bottom of the rear panel of the jacket shell and the bottom of the rear panel of the jacket lining. At this zippered seam, the carrying article may be opened and the bottom of the rear panel of the jacket shell separated from the bottom of the rear panel of the jacket lining. The carrying article is configured inside-out when the jacket is in the as-worn position. Accordingly, when the zipper is opened, the jacket can be easily folded into the carrying article as the carrying article is turned from inside-out to outside-out. After the jacket is folded into the carrying article, snaps positioned in a concealed seam along the bottom of the jacket shell may be closed to separate the folded jacket from the open area of the carrying article, which may be used to carry other articles. The lining may be removable from the jacket shell, and the carrying article may be removable from the lining.

20 Claims, 5 Drawing Sheets

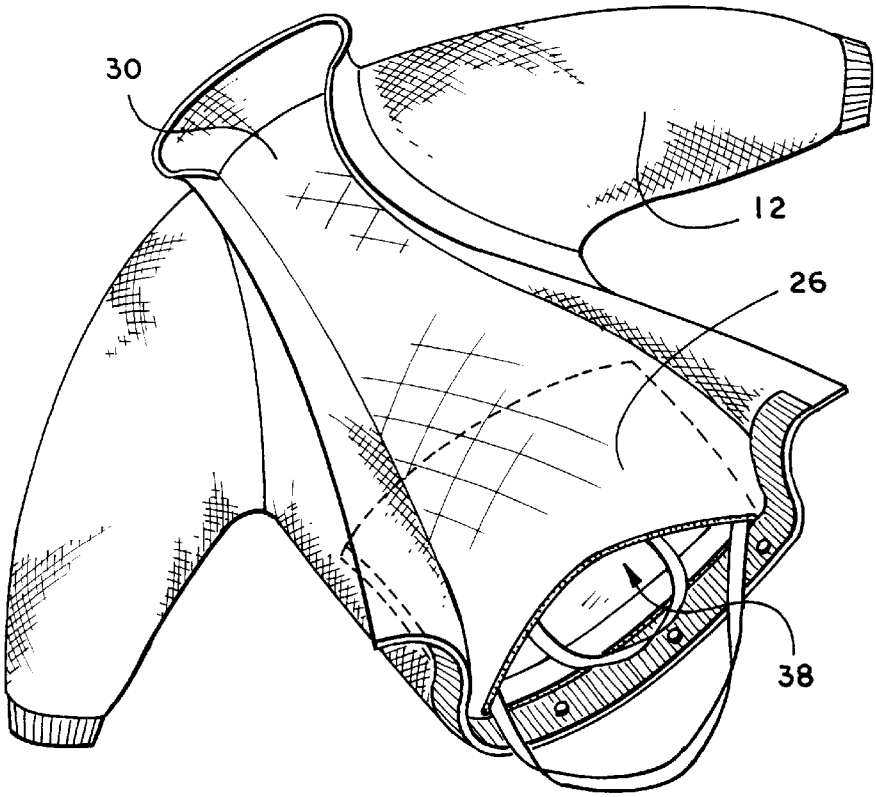
Fig. 3
Fig. 4
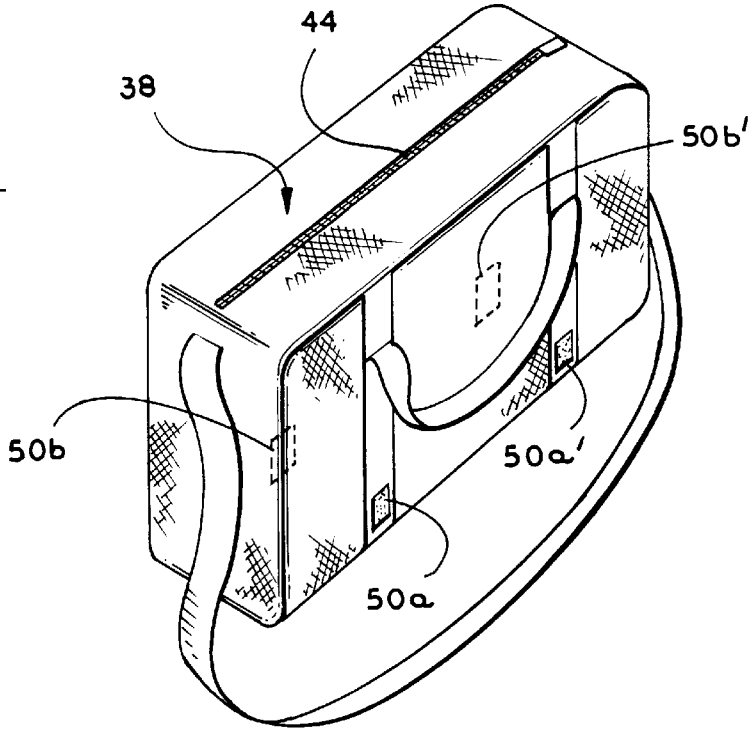

UPPER BODY CLOTHING ARTICLE CONVERTIBLE INTO A CARRYING ARTICLE

TECHNICAL FIELD

This invention relates to an upper body clothing article that converts into a carrying article. In a more specific aspect, this invention relates to a lined convertible jacket in which the carrying article is concealed between the rear panel of the jacket shell and the rear panel of the lining.

BACKGROUND OF THE INVENTION

Upper body clothing articles, such as jackets, that convert into carrying articles are desirable in many situations. For example, a convertible jacket may be used as a tote bag to carry items such as sandwiches and soft drinks to the beach or to a ball game. Later, when the items have been consumed and the weather turns colder, the user can wear the jacket to keep warm. Alternatively, the jacket may be worn to an event such as a parade or concert where souvenirs may be purchased. Once the souvenirs have been purchased, the jacket can be converted into a tote bag for carrying the souvenirs home. Many other occasions may lend themselves to the use of a convertible jacket, such as a walk to a book store, apple picking, going on a picnic, and picking up groceries.

Many different types of convertible jackets have been developed over the years. In some cases, the convertible jackets may not be popular because they look like convertible jackets. That is, readily apparent seams or pouches for the carrying article allow an onlooker to see at a glance that the jacket is convertible, and some people may not find such convertible jackets to be fashionable. Many of these convertible jackets are light weight wind-breaker type garments that are not suitable for use in cold weather. When wearing a light weight convertible jacket, one might feel a carrying article attached to the rear portion of the jacket, particularly when sitting in a seat with a firm back. This may make certain convertible jackets uncomfortable to wear in some situations.

In addition, certain types of convertible jackets are difficult to convert. For example, certain designs include straps that must be fed through holes to convert a jacket into a backpack. Other designs require a complicated folding pattern to convert the jacket into a tote bag. Moreover, many of the prior convertible jacket designs do not allow the carrying article to be separated from the jacket. This reduces the flexibility of the design, as the user must choose between a carrying article or jacket, but cannot use the convertible jacket as a jacket and as a carrying article at the same time.

Thus, there is a general need in the art for a convertible jacket in which seams or pouches associated with the carrying article are not readily visible when the jacket is worn. There is a further need for a convertible jacket that is easy to convert, comfortable to wear and suitable for use in cold weather.

SUMMARY OF THE INVENTION

The present invention meets the needs described above by providing a lined upper body clothing article, such as a jacket, that includes a carrying article, such as a tote bag or backpack, concealed between the jacket shell and the jacket lining. For example, the carrying article may be concealed between the rear panel of the jacket shell (i.e., the back portion of the jacket) and the rear panel of the jacket lining (i.e., the back portion of the lining). The lining makes the jacket suitable for use in cold weather and comfortable to wear despite the presence of the concealed carrying article. When the jacket is in the as-worn position, the carrying article is configured inside-out. This makes the jacket easy to convert because the jacket shell and lining can be easily folded into the carrying article as the carrying article is turned from inside-out to outside-out. In alternative configurations, the lining may be removable from the jacket and/or the carrying article may be removable from the lining. A removable lining and/or carrying article provides the convertible jacket with advantageous flexibility.

Generally described, the present invention is an upper body clothing article that is convertible into a carrying article, thus having an as-worn configuration and a stored configuration. The carrying article is stored in a concealed configuration when the jacket is in the as-worn configuration, and the carrying article converts to a carrying configuration when the jacket is in the stored configuration. The convertible jacket includes a jacket shell defining a rear panel having a bottom portion and a lining defining a rear panel having a bottom portion. The lining is positioned so that the rear panel of the lining opposes the rear panel of the jacket shell, and the bottom portion of the rear panel of the lining is adjacent to the bottom portion of the rear panel of the jacket shell when the jacket is in the as-worn configuration.

A selectively openable seam is located between the bottom portion of the rear panel of the lining and the bottom portion of the rear panel of the jacket shell. The carrying article, which is attached to the bottom portion of the rear panel of the lining, is positioned between the bottom portion of the rear panel of the lining and the bottom portion of the rear panel of the jacket shell when the jacket is in the as-worn configuration. The jacket shell and lining fold into the carrying article as the jacket converts from the as-worn configuration to the stored configuration.

According to an aspect of the invention, the carrying article is configured inside-out when the jacket is in the as-worn configuration and the carrying article is in the concealed configuration. This allows the carrying article to be manipulated from inside-out to outside-out as the jacket is converted from the as-worn configuration to the stored configuration. In addition, the lining of the jacket may include a quilting pattern, and the seams between the carrying article and the lining may correspond to the quilting seam pattern.

Fastening devices may also be attached along the bottom portion of the jacket shell so that the fastening devices may be closed when the jacket is in the stored configuration and the carrying article is in the carrying configuration. In addition, the selectively openable seam between the bottom portion of the rear panel of the lining and the bottom portion of the rear panel of the jacket shell may be defined by a longitudinal fastening device, such as a zipper, that is concealed under a flap of lining material when the jacket is in the as-worn configuration.

According to another aspect of the invention, the jacket may include a selectively openable fastening device between the lining and the carrying article so that the carrying article may be separated from the lining. The jacket may also include a selectively openable fastening device between the lining and the jacket shell so that the lining may be separated from the jacket shell.

That the invention improves over the drawbacks of prior convertible jackets and accomplishes the advantages described above will become apparent from the following detailed description of the preferred embodiments and from the appended drawings and claims.

BRIEF DESCRIPTION OF DRAWINGS

FIG. 3 shows the convertible jacket of FIG. 1 with the jacket in an as-worn configuration and the carrying article in a concealed configuration.

FIG. 4 shows the convertible jacket of FIG. 1 with the jacket in a stored configuration and the carrying article in a carrying configuration.

DETAILED DESCRIPTION OF THE PREFERRED EMBODIMENTS

Figure 1:
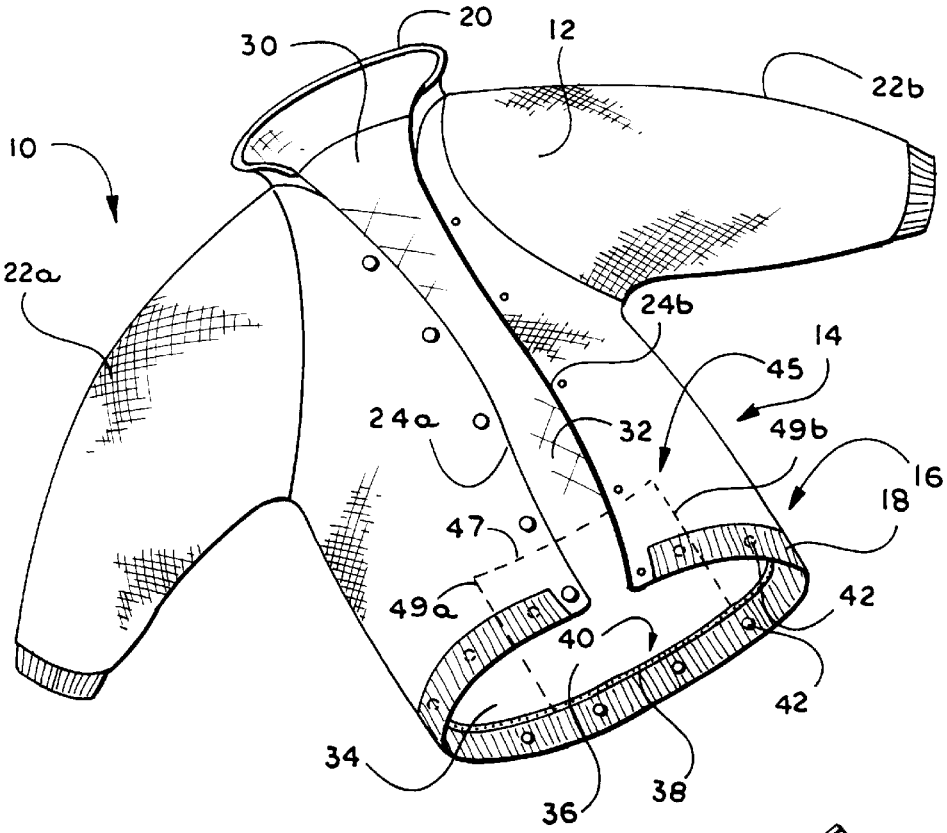
FIG. 1 is a front view of a jacket that is convertible into a carrying article in accordance with the present invention.

The present invention may be embodied in a lined upper body clothing article, such as a jacket, that includes a carrying article, such as a tote bag, concealed between the jacket shell and the jacket lining. In a jacket that opens in the front, the carrying article may be concealed between the rear panel of the jacket shell (i.e., the back portion of the jacket) and the rear panel of the jacket lining (i.e., the back portion of the lining). The present invention may also be deployed in a pullover jacket, heavy shirt or other type of upper body clothing article. In this case, the carrying article may be concealed between the front panel of the upper body clothing article and the front panel of the lining.

Although various types of carrying articles may be concealed within various types of upper body clothing article, for convenience FIGS. 1–10 only show a tote bag concealed within a jacket that opens in the front.

One or more edges of one side of the carrying article is sewn or zippered to the lining, but the shell of the jacket is not attached to the carrying article. This avoids visible seams for supporting the carrying article in the rear panel of the jacket shell. The seams for supporting the carrying article in the lining preferably correspond to a quilting seam pattern in the lining so that the carrying article cannot be detected when looking at the inside of the jacket. The mouth of the carrying article is located at a zippered seam between the bottom of the rear panel of the jacket shell and the bottom of the rear panel of the jacket lining. At this zippered seam, the carrying article may be opened, and the bottom of the rear panel of the jacket shell separated from the bottom of the rear panel of the jacket lining.

The carrying article is configured inside-out when the jacket is in the as-worn position. Accordingly, when the zipper is opened, the jacket can be easily folded into the carrying article as the carrying article is turned from inside-out to outside-out. After the jacket is folded into the carrying article, snaps along the bottom of the jacket shell may be closed to separate the folded jacket from the open area of the carrying article, which may be used to carry other articles. These snaps may be concealed in a seam or under flaps of material.

In an alternative configuration, the lining with attached carrying article may be removed from the jacket. In another alternative configuration, the lining is not removable but the carrying article may be removed from the lining, preferably by way of one or more zippered seams. And in another alternative configuration, both the carrying article and the lining may be separately removable.

Those skilled in the art will appreciate that many different types of carrying articles, such as a backpack, duffel bag or the like could equivalently be concealed between the rear panel of the jacket shell and the rear panel of the jacket lining. The fastening devices located in various places in the jacket may include zippers, buttons, VELCRO® (i.e., a two-piece hook-and-loop fastening device), snaps or any other type of suitable fastening device. In addition, the jacket shell and lining may appear in a variety of garment configurations, such as sleeveless, short-sleeved, collarless, and so forth. The present invention, therefore, is not limited to the specific garment configuration and the specific fastening devices described in this specification.

Referring now to the figures, in which like elements are indicated by like numerals throughout the several figures, FIG. 1 is a front view of a jacket 10 that is convertible into a carrying article in accordance with the present invention. The jacket 10 includes a jacket shell 12 having a rear panel 14. A bottom portion 16 of the rear panel 14 is attached to an elastic fringe material 18 that runs around the bottom portion of the rear panel to define the bottom of the jacket shell. A typical jacket shell 12 also includes a collar 20, two sleeves 22*a* and 22*b*, and two sides 24*a* and 24*b* of a separable opening. As noted above, these features are optional, as the jacket need not include an elastic fringe material and could equivalently be a collarless, sleeveless, pullover or other configuration.

The jacket 10 also includes a lining 30 located within the jacket shell 12. More specifically, the lining 30 includes a rear panel 32 having a bottom portion 34. The lining 30 is positioned within the jacket shell 12 so that the rear panel 32 of the lining opposes the rear panel 14 of the jacket shell, and the bottom portion 34 of the lining is adjacent to the bottom portion 16 of the jacket shell. The jacket 10 also includes a carrying article 36, which is shown in dashed lines, concealed between the bottom portion 34 of the lining and the bottom portion 16 of the jacket shell. As will be discussed in more detail with reference to FIG. 10, the lining 30 may be removable from the jacket shell 12 and the carrying article 36 may be removable from the lining 30.

The carrying article 36 is attached to the lining 30, typically by one or more sewn or zippered seams, but the carrying article 36 is not attached to the jacket shell 12. The carrying article 36 is configured inside-out when the jacket 10 is in the as-worn position and the carrying article 36 is in the concealed position, as shown in FIG. 1. The carrying article 36 may be accessed by way of a selectively openable seam 38, such as a zipper, located between the bottom portion 34 of the rear panel of the lining and the bottom portion 16 of the rear panel of the jacket shell.

The carrying article 36 includes an opening 40, which is positioned adjacent to the selectively openable seam 38.

This allows the jacket shell 12 and lining 30 to be easily folded into the carrying article 36 as the carrying article is turned from inside-out to outside-out. After the jacket shell 12 and lining 30 are folded into the carrying article, optional fastening devices 42 positioned along the bottom of the elastic fringe material 18 may be closed to separate the folded jacket from the open area of the carrying article, which may be used to carry other articles. The operation of the optional fastening devices 42, with the jacket in the stored configuration and the carrying article in the carrying configuration, is shown best in FIG. 8.

The fastening device, typically a zipper, for selectively opening the seam 38 is preferably located under a flap of lining material that conceals the fastening device from view when the jacket is in the as-worn position. The optional fastening devices 42, typically snaps, are also preferably located under flaps in the elastic fringe material that conceal the fastening devices from view when the jacket is in the as-worn position. As an alternative, the fastening devices 42 may be a draw string extending through the elastic fringe material 18 with at least one end passing through an eyelet in the elastic fringe material 18. The draw string may be pulled to draw the elastic fringe material 18 into a closed position. A spring-loaded slider carried on the draw string may then be positioned to hold the elastic fringe material 18 in the closed position.

Furthermore, the seams for attaching the carrying article 36 to the lining 30 preferably correspond to a quilting pattern in the lining. Thus, the jacket 10 looks like a typical, non-convertible jacket when the jacket is in the as-worn position. In addition, the lining 30 cushions the back of the jacket 10 so that the jacket is comfortable to wear, even in a seat with a hard back, despite the presence of the carrying article.

Figure 2:
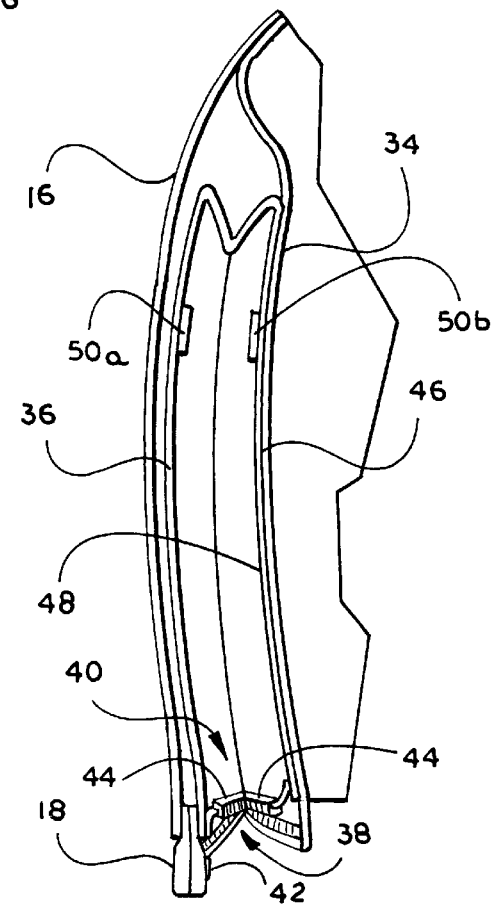
FIG. 2 is a view through a cross section of the rear portion of the convertible jacket shown in FIG. 1.

FIG. 2 shows a view through a cross section of the rear portion of the convertible jacket 10. As shown in FIG. 2, the carrying article 36, which is attached to the lining 30 but not attached to the jacket shell 12, is located between the bottom portion 34 of the rear panel of the lining and the bottom portion 16 of the rear panel of the jacket shell. The selectively openable seam 38 between the bottom portion 34 of the rear panel of the lining and the bottom portion 16 of the rear panel of the jacket shell is positioned adjacent to a fastening device 44, such as a zipper, which is located in the mouth 40 of the carrying article 36. The fastening device 44 is optional, as the mouth of the carrying article 36 may or may not include a fastening device.

The carrying article 36 is preferably attached to the lining 30 by way of a sewn or zippered seam 45 that runs around the perimeter of the side 48 of the carrying article 36 that opposes the lining 30. The sewn or zippered seam 45 may alternatively run around three edges, or only along the top edge 47, of the carrying article 36. As an alternative, two sewn or zippered seams may run along the vertical edges 49*a* and 49*b* of the carrying article 36. The seam 45 prevents the carrying article 36 from slumping into the bottom of the jacket 10. The carrying article 36 may also include fastening devices 50*a* and 50*b*, such as snaps or VELCRO®, positioned on opposing sides of the carrying article. These fastening devices may be attached to each other when the carrying article 36 is in the concealed position to further prevent the carrying article from slumping into the bottom of the jacket 10. The fastening devices 50*a* and 50*b* are on the outside surface of the carrying article 26 when the article is in the carrying configuration.

FIG. 3 shows the convertible jacket 10 in the as-worn configuration with the carrying article 36 in the concealed configuration. With the jacket in this position, the carrying article 36 may be accessed by opening the selectively openable seam 38 between the bottom portion 34 of the rear panel of the lining and the bottom portion 16 of the rear panel of the jacket shell. With the seam 38 open, the jacket 10 may be easily converted from the as-worn configuration to the stored configuration, as the carrying article 36 is turned from inside-out to outside-out (i.e., as the carrying article is converted from the concealed configuration to the carrying configuration).

FIG. 4 shows the convertible jacket 10 in the stored configuration with the carrying article 36 in the carrying configuration. With the jacket in this position, the jacket shell 12 and lining 30 are inside the carrying article 36. The optional fastening devices 50*a* and 50*b*, which help prevent the carrying article 36 from slumping into the bottom of the jacket 10 when the jacket is in the as-worn configuration, are located on the outside surface of the carrying article.

FIGS. 5–8 are a sequence of drawings illustrating the conversion of the jacket 10 from the as-worn configuration with the carrying article 36 in the concealed configuration, as shown in FIG. 3, to the jacket in the stored configuration with the carrying article in the carrying configuration, as shown in FIG. 4. That is, the sequence of drawings FIGS. 5–8 illustrates the transition from FIG. 4 to FIG. 5, in which the jacket 10 is folded into the carrying article 36 as the carrying article is turned from inside-out to outside-out.

Figure 5:
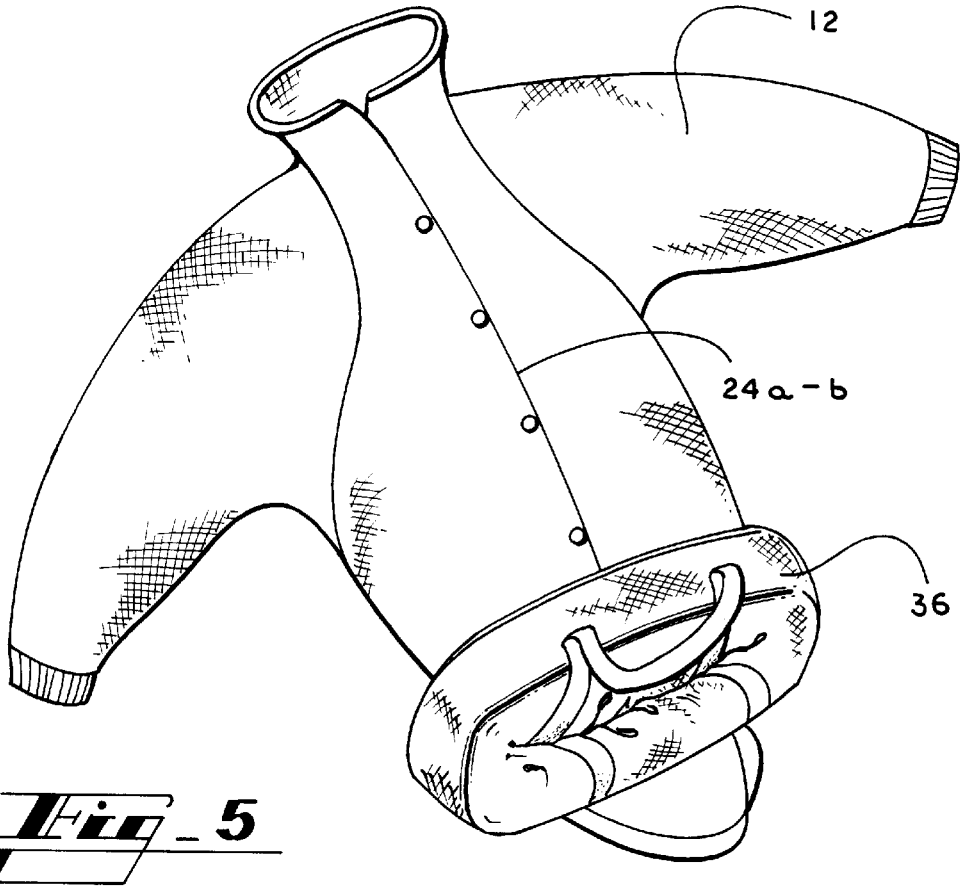
FIG. 5 illustrates a first step in the conversion of the jacket of FIG. 1 from the as-worn configuration to the carrying configuration.

FIG. 5 shows a first step in the conversion process, in which the carrying article 26 is partially turned from inside-out to outside-out. It should be noted that carrying article 26 turns from inside-out to outside-out through the selectively openable seam 38 between the bottom portion 34 of the rear panel of the lining and the bottom portion 16 of the rear panel of the jacket shell. Thus, the carrying article 26 wraps around the jacket shell 12 and the lining 30 as the shell and lining fold into the carrying article. The separable openings 24*a* and 24*b* in the front of the jacket 10 are preferably closed before turning the carrying article 26 from inside-out to outside-out. This facilitates closing the fastening devices 42 after the jacket shell 12 and the lining 30 have been fully folded into the carrying article 26, as shown best in FIG. 8.

Figure 6:
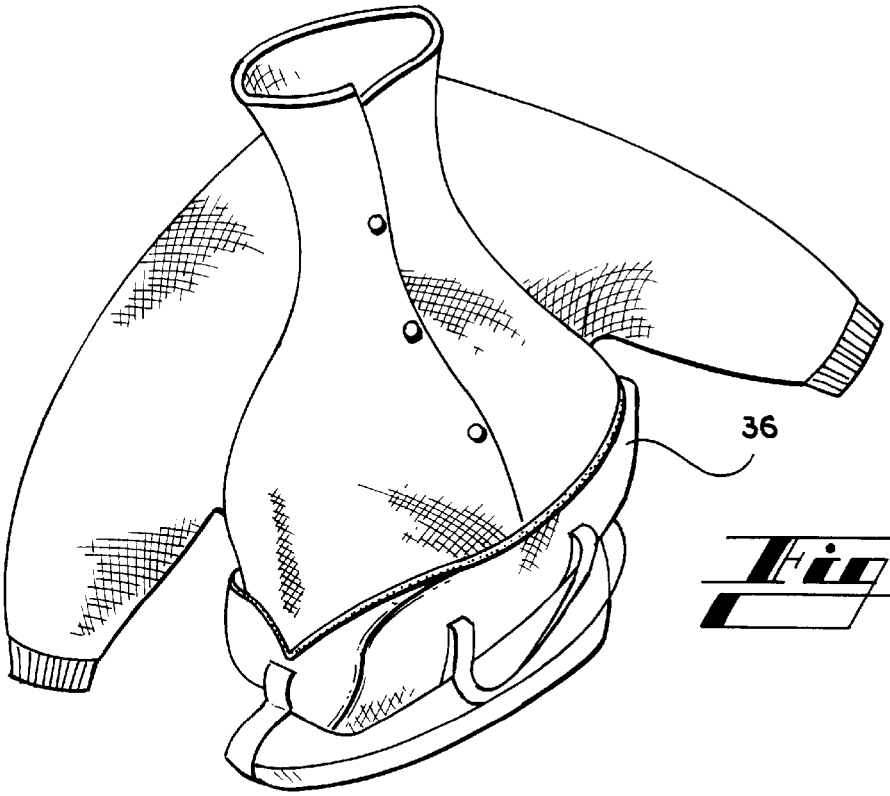
FIG. 6 illustrates a second step in the conversion of the jacket of FIG. 1 from the as-worn configuration to the carrying configuration.
Figure 7:
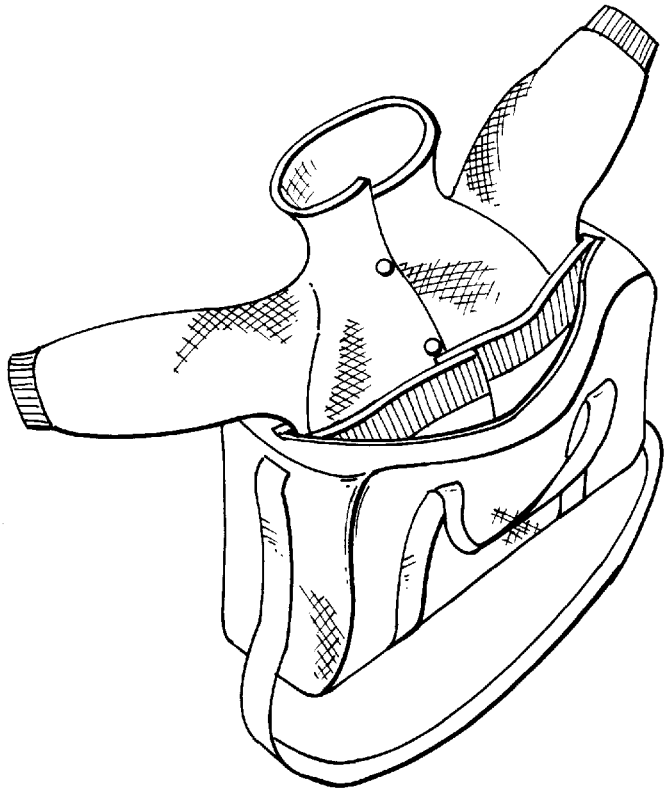
FIG. 7 illustrates a third step in the conversion of the jacket of FIG. 1 from the as-worn configuration to the carrying configuration.

FIG. 6 illustrates a second step in the conversion of the jacket 10. In this step, the carrying article 36 is fully turned outside-out and the jacket shell 12 and lining 30 remain partially outside of the carrying article. From this position, the jacket shell 12 and lining 30 may be further folded into the carrying article 36, as shown in FIG. 7.

Figure 8:
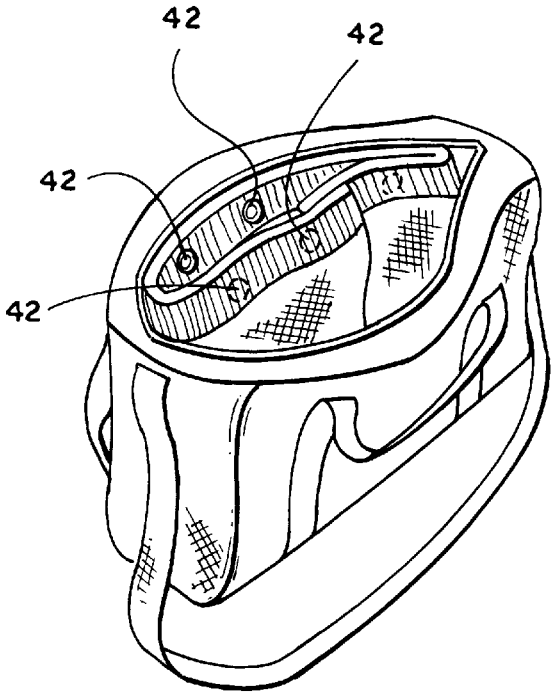
FIG. 8 illustrates a fourth step in the conversion of the jacket of FIG. 1 from the as-worn configuration to the carrying configuration.

FIG. 8 shows the jacket shell 12 and lining 30 fully folded into the carrying article 36, at which point the fastening devices 42 along the elastic fringe material 18 may be closed to separate the folded jacket from the open area of the carrying article, which may be used to carry other articles.

Figure 9:
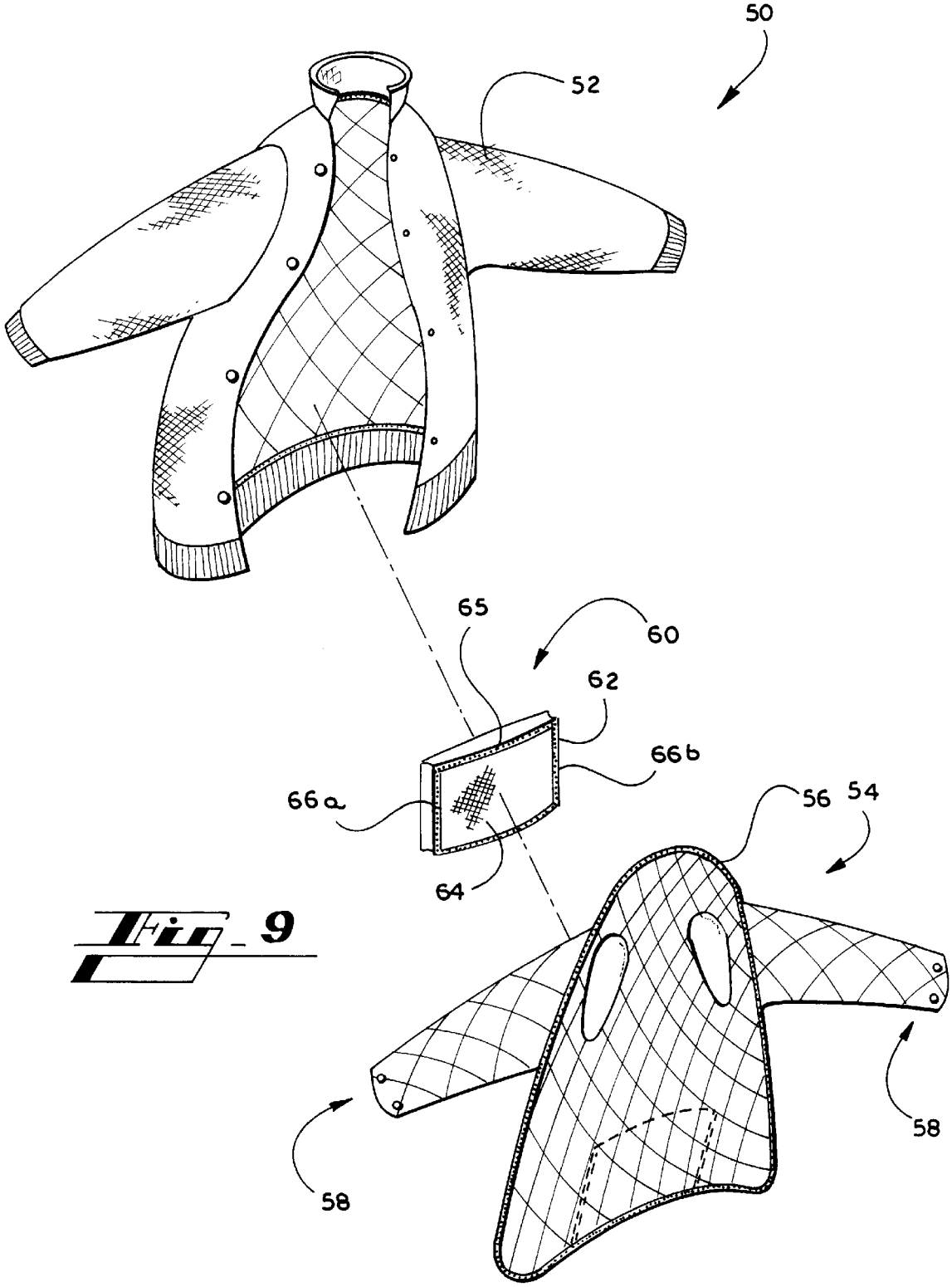
FIG. 9 is a exploded view illustrating a convertible jacket having a removable lining and a carrying article that is removable from the lining.

FIG. 9 is an exploded view illustrating an alternative convertible jacket 50 that includes a jacket shell 52 with a removable lining 54 and a carrying article 60 that is removable from the lining. This embodiment is substantially similar to the convertible jacket 10 described with reference to FIGS. 1–8, except that the lining 54 is removable from the jacket shell 52, and the carrying article 60 is removable from the lining 54.

To allow the lining 54 to separate from the jacket shell 52, the jacket 50 includes a selectively openable seam 56, such as a zipper, between the lining and the jacket shell. The lining 54 may also include buttons 58 or other fastening devices on the sleeves that selectively attach to loops or eyes on the inside of the sleeves of the jacket shell 52. In addition, to allow the carrying article 60 to separate from the jacket shell 52, the jacket 50 includes a selectively openable seam 62, such as a zipper, between the lining 54 and the carrying article 60. The selectively openable seam 62 may run around the perimeter of the side 64 of the carrying article 60 that opposes the lining 54. The seam 62 may alternatively run around three edges, or only along the top edge 65, of the carrying article 60. As another alternative, two separate selectively openable seams may run along the vertical edges 66*a* and 66*b* of the carrying article 36.

The configuration of the jacket 50, with the removable lining 54 and carrying article 60, improves the flexibility of the design, as the convertible jacket may be used as carrying article and jacket, either with or without a lining, at the same time. The jacket 50 may alternatively be configured with a non-removable lining and a removable carrying article, or with a removable lining and a non-removable carrying article. Several different convertible jacket configurations may, therefore, be offered to meet differing utility and cost objectives.

The present invention provides a jacket that converts into a carrying article in which seams or pouches associated with the carrying article are not readily visible when the jacket is worn. The invention also provides a convertible jacket that is easy to convert, comfortable to wear and suitable for use in cold weather. It should be understood that the foregoing pertains to the preferred embodiments of the present invention, and that numerous changes may be made to the embodiments described herein without departing from the spirit and scope of the invention as defined in the following claims.

What is claimed is:

1. A convertible upper torso clothing article having an as-worn configuration and a stored configuration, comprising:

a shell having a bottom portion;

a lining having a bottom portion, the lining positioned so the bottom portion of the lining is adjacent to the bottom portion of the shell when the upper body clothing article is in the as-worn configuration;

a selectively openable seam between the bottom portion of the lining and the bottom portion of the shell;

a carrying article attached to the bottom portion of the lining and having a concealed configuration and a carrying configuration; and the upper body clothing article converting from the as-worn configuration to the stored configuration as the carrying article converts from the concealed configuration to the carrying configuration, wherein the shell and the lining are foldable into the carrying article when the carrying article is in the carrying configuration and the upper body clothing article is in the stored position, and the carrying article is positioned between the shell and the lining when the upper body clothing article is in the as-worn configuration and the carrying article is in the concealed configuration.

2. The convertible upper torso clothing article of claim 1, wherein:

the upper body clothing article is a jacket defining a front panel having an opening;

the shell defines a rear panel having a bottom portion;

the lining defines a rear panel having a bottom portion, the lining positioned so that the rear panel of the lining opposes the rear panel of the shell and the bottom portion of the rear panel of the lining is adjacent to the bottom portion of the rear panel of the shell when the jacket is in the as-worn configuration;

the selectively openable seam is positioned between the bottom portion of the rear panel of the lining and the bottom portion of the rear panel of the shell;

the carrying article is attached to the bottom portion of the rear panel of the lining; and the carrying article is configured inside-out when the jacket is in the as-worn configuration and the carrying article is in the stored configuration, wherein the carrying article is converted from inside-out to outside-out as the carrying article is converted from the concealed configuration to the carrying configuration and the jacket is converted from the as-worn configuration to the stored configuration.

3. The upper torso clothing article of claim 1, wherein:

the lining includes a quilting pattern; and the attachment between the carrying article and the lining includes a seam that corresponds to the quilting seam pattern.

4. The upper torso clothing article of claim 2, further comprising:

fastening devices attached to the bottom portion of the shell so that the fastening devices may be closed when the jacket is in the stored configuration and the carrying article is in the carrying configuration.

5. The upper torso clothing article of claim 2, wherein the selectively openable seam between the bottom portion of the rear panel of the lining and the bottom portion of the rear panel of the shell is defined by a longitudinal fastening device that is concealed when the jacket is in the as-worn configuration.

6. The upper torso clothing article of claim 1, further comprising a selectively openable fastening device between the lining and the carrying article so that the carrying article may be separated from the lining.

7. The upper torso clothing article of claim 1, further comprising a selectively openable fastening device between the lining and the shell so that the lining may be separated from the shell.

8. The upper torso clothing article of claim 1, further comprising:

a selectively openable fastening device between the lining and the carrying article so that the carrying article may be separated from the lining; and a selectively openable fastening device between the lining and the shell so that the lining may be separated from the shell.

9. The upper torso clothing article of claim 1, wherein the carrying article comprises a tote bag.

10. The upper torso clothing article of claim 1, wherein the carrying article comprises a back pack.

11. A convertible jacket having an as-worn configuration and a stored configuration, comprising:

a jacket shell defining a rear panel having a bottom portion;

a lining defining a rear panel having a bottom portion, the lining positioned so that the rear panel of the lining opposes the rear panel of the jacket shell and the bottom portion of the rear panel of the lining is adjacent to the bottom portion of the rear panel of the jacket shell when the jacket is in the as-worn configuration;

a selectively openable seam between the bottom portion of the rear panel of the lining and the bottom portion of the rear panel of the jacket shell;

a carrying article attached to the bottom portion of the rear panel of the lining and having a concealed configuration and a carrying configuration; and the jacket converting from the as-worn configuration to the stored configuration as the carrying article converts from the concealed configuration to the carrying configuration, wherein the jacket shell and the jacket lining are foldable into the carrying article when the carrying article is in the carrying configuration and the jacket is in the stored position, the carrying article is positioned between the rear panel of the jacket shell and the rear panel of the lining when the jacket is in the as-worn configuration and the carrying article is in the concealed configuration, and the carrying article is configured inside-out when the jacket is in the as-worn configuration and the carrying article is in the stored configuration, so that the carrying article is converted from inside-out to outside-out as the carrying article is converted from the concealed configuration to the carrying configuration and the jacket is converted from the as-worn configuration to the stored configuration.

12. The jacket of claim 11, further comprising a selectively openable fastening device between the lining and the carrying article so that the carrying article may be separated from the lining.

13. The jacket of claim 11, further comprising a selectively openable fastening device between the lining and the jacket shell so that the lining may be separated from the jacket shell.

14. The jacket of claim 11, further comprising:

a selectively openable fastening device between the lining and the carrying article so that the carrying article may be separated from the lining; and a selectively openable fastening device between the lining and the jacket shell so that the lining may be separated from the jacket shell.

15. The jacket of claim 11, wherein the carrying article comprises a tote bag.

16. The jacket of claim 11, wherein the carrying article comprises a back pack.

17. A convertible jacket having an as-worn configuration and a stored configuration, comprising:

a jacket shell defining a rear panel having a bottom portion;

a lining defining a rear panel having a bottom portion, the lining positioned so that the rear panel of the lining opposes the rear panel of the jacket shell and the bottom portion of the rear panel of the lining is adjacent to the bottom portion of the rear panel of the jacket shell when the jacket is in the as-worn configuration;

a selectively openable seam between the bottom portion of the rear panel of the lining and the bottom portion of the rear panel of the jacket shell;

a carrying article attached to the bottom portion of the rear panel of the lining and having a concealed configuration and a carrying configuration;

the jacket converting from the as-worn configuration to the stored configuration as the carrying article converts from the concealed configuration to the carrying configuration, wherein the jacket shell and the jacket lining are foldable into the carrying article when the carrying article is in the carrying configuration and the jacket is in the stored position, the carrying article is positioned between the rear panel of the jacket shell and the rear panel of the lining when the jacket is in the as-worn configuration and the carrying article is in the concealed configuration, and the carrying article is configured inside-out when the jacket is in the as-worn configuration and the carrying article is in the stored configuration, so that the carrying article is manipulated from inside-out to outside-out as the carrying article is converted from the concealed configuration to the carrying configuration and the jacket is converted from the as-worn configuration to the stored configuration; and a selectively openable fastening device between the lining and the carrying article so that the carrying article may be separated from the lining.

18. The jacket of claim 17, further comprising a selectively openable fastening device between the lining and the jacket shell so that the lining may be separated from the jacket shell.

19. The jacket of claim 17, wherein the carrying article comprises a tote bag.

20. The jacket of claim 17, wherein the carrying article comprises a back pack.

* * * * *